US005624210A

United States Patent [19]

Baldwin et al.

[11] Patent Number: 5,624,210

[45] Date of Patent: Apr. 29, 1997

[54] COLLISION TOLERANT PILE STRUCTURE

[75] Inventors: Kenneth C. Baldwin, Lee; Moses R. Swift, Durham, both of N.H.

[73] Assignee: The University of New Hampshire, Durham, N.H.

[21] Appl. No.: 380,527

[22] Filed: Jan. 30, 1995

[51] Int. Cl.[6] ..... E02D 7/00; B63B 22/18

[52] U.S. Cl. ..... 405/232; 441/21; 40/608

[58] Field of Search ..... 405/232, 211, 405/202; 40/608; 441/21, 28, 6; 114/219

[56] References Cited

U.S. PATENT DOCUMENTS

| | | | |
|---|---|---|---|
| 1,266,152 | 5/1918 | Poole | 40/608 |
| 2,141,067 | 12/1938 | Miller | 40/608 X |
| 3,605,147 | 9/1971 | Shelton | 441/6 |
| 3,732,588 | 5/1973 | Mitchell | 441/21 |
| 3,800,347 | 4/1974 | Zuurbier | 441/21 |
| 4,106,879 | 8/1978 | Diedershagen et al. | 40/608 X |
| 4,280,238 | 7/1981 | Van Heijst | 441/21 |
| 4,491,438 | 1/1985 | Bervtti | 40/608 X |
| 5,006,009 | 4/1991 | Griffin | 40/608 X |
| 5,090,348 | 2/1992 | Hugron | 40/608 X |

*Primary Examiner*—Tamara L. Graysay
*Assistant Examiner*—Frederick L. Lagman
*Attorney, Agent, or Firm*—Otto M. Wildensteiner

[57] ABSTRACT

A support pile assembly for an aid to navigation that is to be placed in an area where it will be subject to repeated hits by boats and barges. In one configuration the assembly comprises a foundation which is driven into the mud on the bottom and which receives the support pile, and the support pile, which slips into the foundation. The support pile comprises three sections: a lower section which fits in the foundation; a spring section that is attached to the lower section by means of a joint in such a way that it cart flex in all directions; and an upper section, rigidly fixed to the spring section, to which the aid to navigation is attached. A compression spring in the spring section gets compressed whenever the pile is hit by a ship or barge and forced out of its normal vertical position; as the spring extends back to its original length, it causes the pile to revert to the vertical position.

A second configuration is the same as the first except that the foundation rests on the bottom and the support pile comprises only the spring section and the upper section. The joint is bolted onto the base rather than onto the lower section as in the first configuration.

16 Claims, 4 Drawing Sheets

COLLISION TOLERANT PILE STRUCTURE

STATEMENT OF GOVERNMENT INTEREST

The present invention may be made or used by or on behalf of the Government of the United States without the payment of any royalties thereon or therefor.

BACKGROUND

Aids to navigation (ATONs) other than anchored buoys are mounted on piles that are set into the mud or other bottom of a river, etc. in order to mark the channel or obstructions on the bottom. In places where the channel is wide, they are usually not struck by passing marine traffic. However, in places where the channel is narrow or where the traffic is dense they get struck quite frequently. If the pile is rigid and the striking vessel is large; the pile gets snapped off. If the striking vessel is small, or the pile is flexible and is not displaced much, the pile survives. If the pile survives but not the ATON, replacing just the ATON is much simpler and cheaper than replacing both the pile and the ATON.

The prior art has made many attempts to design a pile that will withstand repeated strikings by marine traffic and remain functional However, all of these designs suffer from drawbacks such as being excessively complex or expensive; some have external cables, etc. which degrade over time and repeated minor strikings to the point where they will not function; and others fail for some other reason. For these reasons ATON support piles remain for the most part wooden posts driven into the bottom, and therefore need to be replaced each time they are struck.

OBJECTS

Accordingly, it is an object of the present invention to provide an ATON support pile that can survive repeated strikes without incurring damage to itself.

It is a further object of the present invention to provide an ATON support pile that is cost effective to produce and install.

It is a further object of the present invention to provide an ATON support pile that can be installed in any type of bottom.

It is a further object of the present invention to provide an ATON support pile having an internal self-righting mechanism.

SUMMARY OF THE PRESENT INVENTION

Briefly, the present invention is a negatively buoyant ATON support pile that includes a joint at the mud line that allows it to flex in any direction after being struck. The pile is made up of 3 sections, the lower of which slips into a base member that is anchored in the mud or other bottom material; the sections are made of conventional large-diameter iron or steel pipe. The joint comprises a generally conical member on the lower section and a generally bell-shaped member on the middle section which fits over the conical member. The middle section contains a pre-loaded compression spring which is compressed when the pile flexes about the joint, and when the spring expands to its initial length it forces the pile back to the vertical. The upper section extends above the waterline, and supports the ATON. An alternate configuration, for use in areas with hard bottoms, comprises the upper and middle sections fastened to a fiat reinforced concrete base, by means of the same joint, that sits on the bottom.

DESCRIPTION OF THE PREFERRED EMBODIMENT

Figure 1:
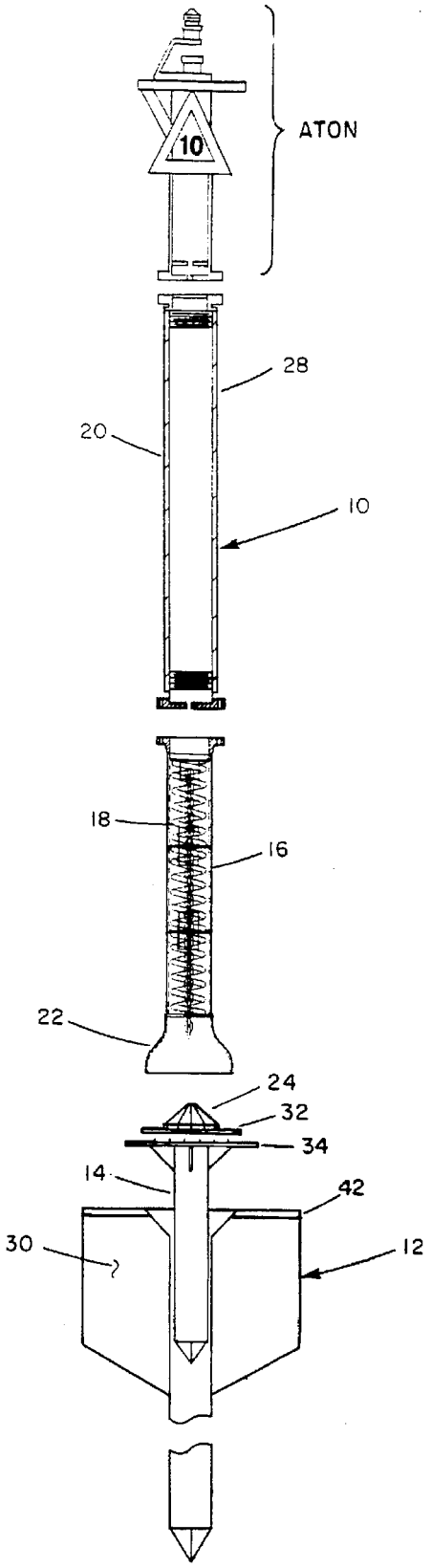
FIG. 1 is an exploded view of the ATON support pile of the present invention.

FIG. 1 shows pile structure 10 of the present invention with base 12 that is used in mud or soft sand bottoms. Pile structure 10 comprises lower section 14, which slips into the bore in base 12; middle section 16, which contains spring 18; and upper section 20. Upper section 20 is rigidly bolted or otherwise fixed to middle section 16. Middle section 16 is attached to lower section 14 by means of joint 21 (see FIGS. 3 and 4) which allows flexing in all directions.

Figure 2:
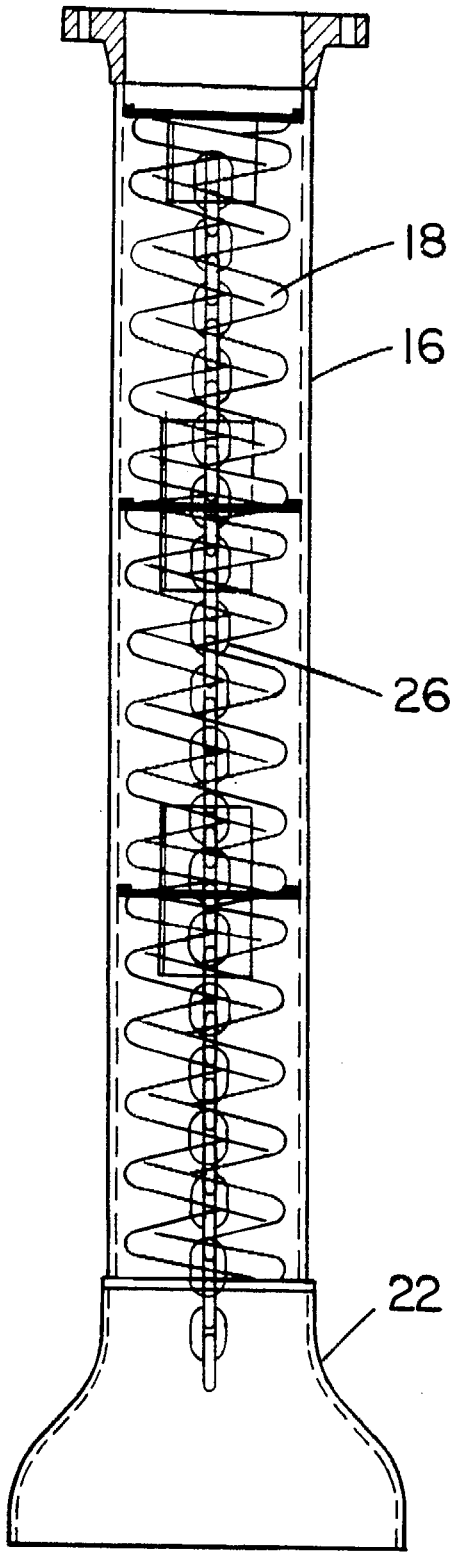
FIG. 2 is an enlarged view of the middle section of the ATON support pile of the present invention showing the compression spring.

Joint 21 comprises bell-shaped portion 22 on the bottom of middle section 16 which fits over conical member 24 which is bolted onto lower section 14. A cable or chain 26 (see FIG. 2) is connected to the center of conical member 24 and to the top of compression spring 18 with enough pre-load to keep pile structure 10 upright in the water.

Upper section 20 is made of large diameter pipe and may be either sealed at each end or filled with foam for buoyancy. By itself upper section 20 is positively buoyant; when attached to the rest of the components of pile structure 10, however, its buoyancy is not enough to give positive buoyancy to the entire pile. It is this overall negative buoyancy which keeps pile 10 from floating out of base 12. Upper section 20 also preferably has a foam or other cushioning layer 28 on its outside to reduce the shock of impacts on the ATON. Cushioning 28 may also contribute to positive buoyancy, but should not be enough to cause pile 10 to float out of base 12.

Middle section 16 is made of the same pipe, as upper section 20. It contains compression spring 18 within it, which is the means of restoring the entire pile to the vertical after it has been struck. Spring 18 is fixed at its lower end to the inside of middle section 16, while its upper end is free to move vertically within middle section 16. The bottom of middle section 16 ends in bell-shaped portion 22, which can be a separate piece which is welded or otherwise attached to the straight portion of middle section 16. Bell-shaped portion 22 comprises one of the parts of joint 21 which allows the pile to be knocked over and recover without damage.

Cable or chain 26, which runs inside spring 18, is attached at its upper end to the upper end of spring 18. It is fixed at its lower end to generally conical member 24 with a pre-load, as will be explained below.

Lower section 14 is also made of the same pipe as upper section 20, but can have a smaller diameter. It has plate 34 welded to it at its top to which generally conical member 24 is bolted. Plate 34 may be reinforced with gussets as shown. The bottom of lower section 14 has a slight point on it as shown to help in guiding it into base 12.

Base 12 is a section of pipe large enough to allow lower section 14 to slide into it, with "wings" 30 welded onto it for added stability in soft mud. It is driven into the bottom until plate 42 is flush with the mud line,and then lower section 14 of pile structure 10 is slipped into it and the ATON is bolted onto the top of upper section 20. The length of base 12 and the size of its wings 30 will be a function of the material on the bottom and the water currents, marine traffic, etc. that exist at the site.

Figure 3:
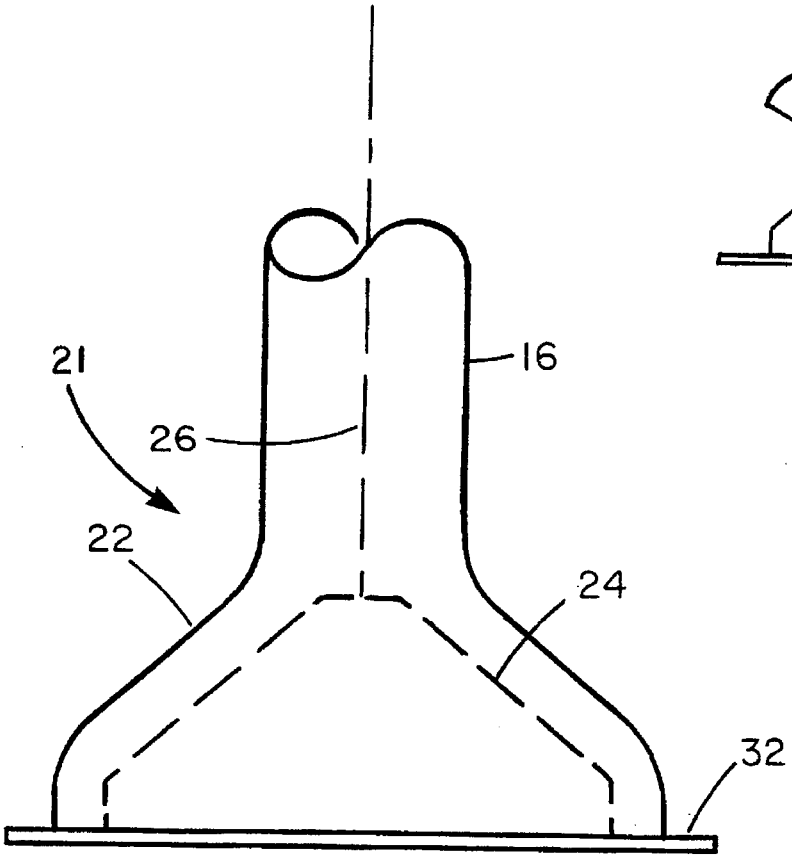
FIG. 3 shows the joint when the pile is in the vertical position.

FIG. 3 shows joint 21 when pile 10 is in the vertical position. When cable or chain 26 is fastened to generally conical member 24 spring 18 is given a certain amount of pre-load, which puts a tensile force in cable or chain 26. It is this force from spring 18 which keeps bell-shaped portion 22 centered on conical member 24, with the bottom of bell-shaped portion 22 resting on plate 32; this keeps pile 10 vertical. The amount of pre-tensioning required for this will be a function of the forces exerted on pile 10 by the water currents, tides, wind, wakes from passing traffic, etc. As shown in FIG. 1, generally conical member 24 is welded or otherwise fixed to plate 32 and plate 34 is welded or otherwise fixed to lower section 14. Plate 32 is bolted to plate 34; this allows the piling structure of the present invention to be used with either base 12 for soft bottoms or base 36 of FIGS. 5 and 6 for hard bottoms.

Wings 30 have plate 42 welded onto them as shown in FIG. 1. Plate 42 has an opening in it which allows lower section 14 to be slipped into base 12. When pile 10 is lowered into the water and into base 12, plate 34 rests on plate 42 and is thereby supported at the mud line.

Figure 4:
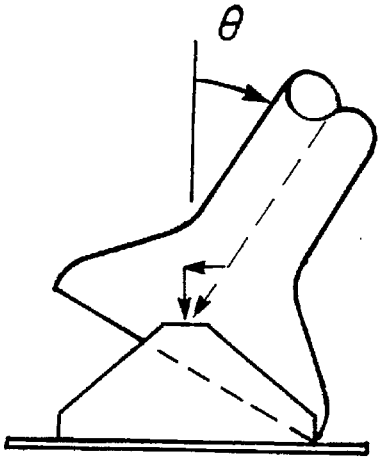
FIG. 4 shows the joint when the pile has been struck.

FIG. 4 shows joint 21 when pile 10 has been struck. The part of pile 10 above joint 21 is displaced by an angle θ from the vertical, which causes bell-shaped portion 22 to tilt about one side. As it tilts, cable or chain 26 compresses spring 18 which increases the force in cable or chain 26. The force in chain 26 can be resolved into horizontal and vertical components as shown in FIG. 4; the horizontal component of this force is the force that restores pile 10 to the vertical position. As it returns to the vertical, conical member 24 guides it back into proper place. Since joint 21 is symmetrical about its centerline, it can pivot in any direction.

A large ship striking pile 10 can force it entirely beneath the surface of the water; if the ship happens to strike it broadside, it may slide along the length of the pile and strip the ATON from it. Pile 10 will be restored, undamaged, by the force in chain or cable 26, and the ATON can be easily replaced.

Figure 5:
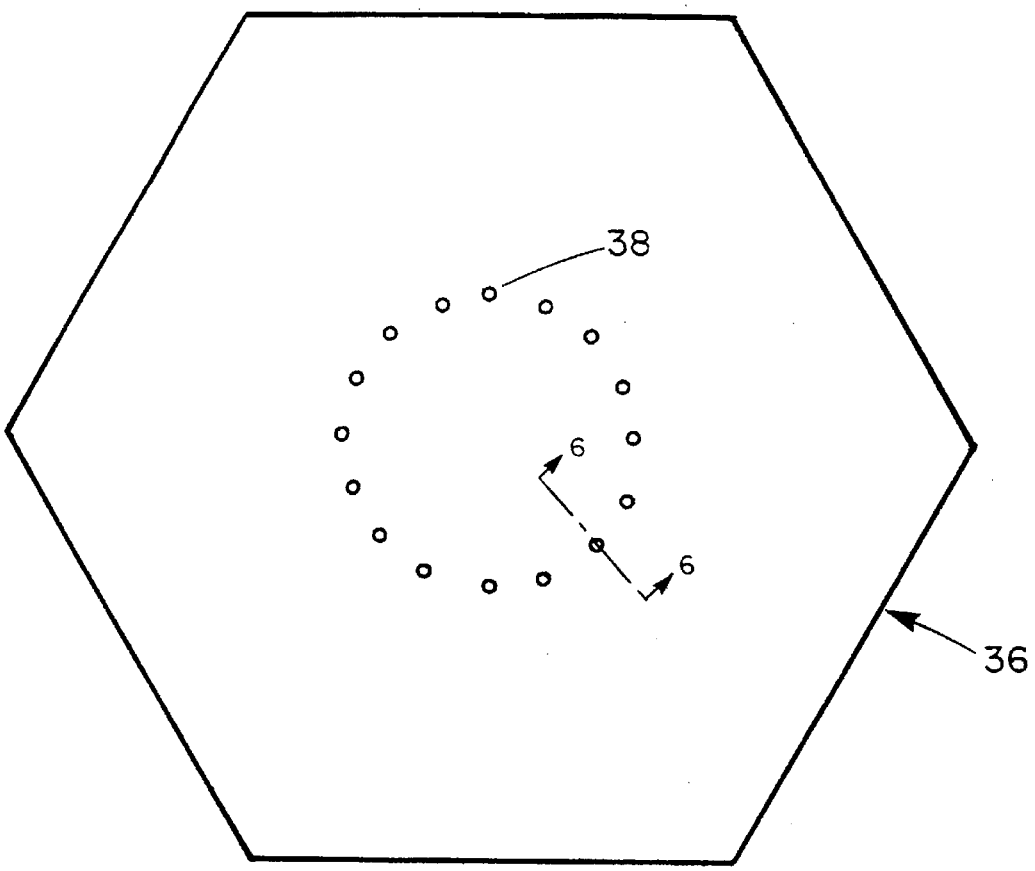
FIG. 5 shows a top view of an alternative form of base for use on hard bottoms.
Figure 6:
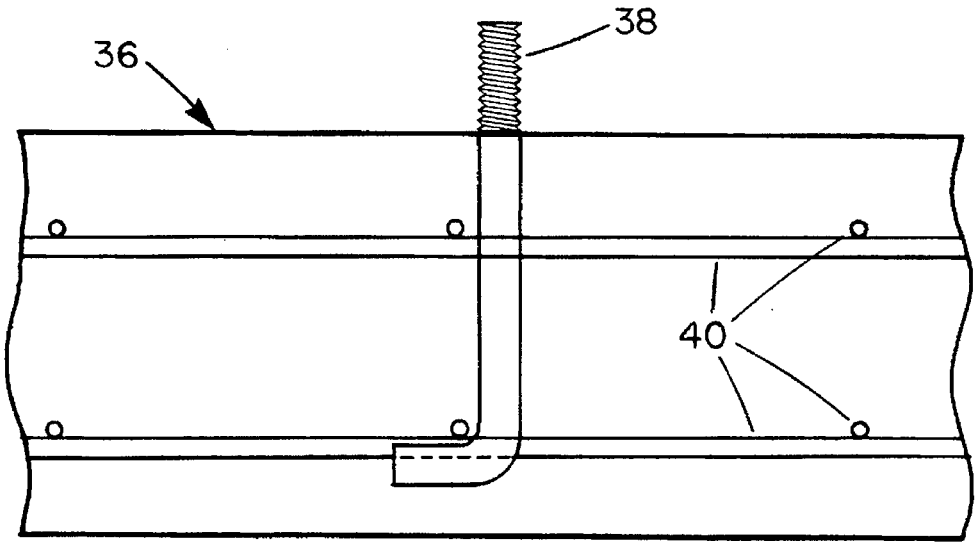
FIG. 6 is taken along line 6—6 of FIG. 5.

FIGS. 5 and 6 show an alternative base configuration 36 for use on hard bottoms. Base 36 is a large reinforced concrete slab that rests on the bottom rather than being driven into it. Plate 32 of joint 21 is bolted onto base 36 by means of bolts 38 which are set into the concrete. Joint 21 functions the same as it does in the previous configuration. As shown, bolts 38 are preferably hooked under reinforcing bars 40 for added strength and integrity. Base 36 depends on its weight and diameter for stability, rather than on being sunk into the bottom like base 12. Therefore its dimensions and weight will depend on the conditions expected to be encountered at a given site.

For this configuration, pile structure 10 comprises upper section 20, middle section 16, and base 36 since they are fastened together on board ship or on land and then lowered over the side as a unit. Base 36 thus has to be heavy enough to make the entire unit negatively buoyant as well as withstand the forces exerted on it by the water and striking vessels.

The reason for making the part of piling 10 above the joint in two sections rather than one is that middle section 16, which contains the restoring spring, can be made in one length and upper section 20 can be made in different lengths to accommodate different water depths. The additional weight and drag of a longer upper section 20 merely requires additional pre-load in spring 18.

What is claimed is:

1. A collision tolerant marine pile structure for placement on the bottom of a body of water comprising a base member that is adapted to be driven into the bottom and a vertical member received in said base member, said vertical member being comprised of a plurality of sections one of which is positively buoyant but said vertical member being overall negatively buoyant and having means for returning it to a vertical position after being contacted by a ship or other vessel.

2. A collision tolerant pile structure as in claim 1 wherein said means for returning it to a vertical position is contained within said vertical member.

3. A collision tolerant pile structure as in claim 2 wherein said means for returning it to a vertical position comprises a spring.

4. A collision tolerant pile structure as in claim 3 wherein said spring is a compression spring having an upper end and a lower end.

5. A collision tolerant pile structure as in claim 4 wherein said vertical member comprises 3 sections, an upper section, a middle section, and a lower section, the upper two of which are are rigidly fixed to each other.

6. A collision tolerant pile structure as in claim 5 wherein said upper two rigidly fixed sections are attached to the lower section by means of a joint which allows flexure in all directions.

7. A collision tolerant pile:structure as in claim 6 wherein said lower section fits into said base member.

8. A collision tolerant pile structure as in claim 7 wherein said joint which allows flexure in all directions comprises a generally conical member attached to said lower section and a generally bell-shaped portion on said middle section which fits over said generally conical member.

9. A collision tolerant pile structure as in claim 8 wherein the upper end of said compression spring is attached to said generally conical member by means of a flexible member.

10. A collision tolerant marine pile structure for placement on the bottom of a body of water comprising a base member that rests on the bottom and a vertical member attached to said base, said vertical member being comprised of a plurality of sections one of which is positively buoyant but said vertical member being overall negatively buoyant and having means for returning it to a vertical position after being contacted by a ship or other vessel.

11. A collision tolerant pile structure as in claim 10 wherein said means for returning said vertical member to a vertical position is contained within said vertical member.

12. A collision tolerant pile structure as in claim 11 wherein said means for returning said vertical member to a vertical position is a spring.

13. A collision tolerant pile structure as in claim 12 wherein said spring is a compression spring having a top and a bottom.

14. A collision tolerant pile structure as in claim 13 including a joint between said base member and said vertical member which allows flexure in all directions.

15. A collision tolerant pile structure as in claim 14 wherein said joint comprises a generally conical member having a center attached to said base member and a generally bell-shaped section on the bottom of said vertical member which fits over said generally conical member.

16. A collision tolerant pile structure as in claim 15 further including a flexible member attached to the center of said generally conical member and the top of said spring.

* * * * *